US006607202B1

(12) United States Patent
Palmer

(10) Patent No.: US 6,607,202 B1
(45) Date of Patent: Aug. 19, 2003

(54) ORTHOTIC WALKER

(75) Inventor: Roy Thomas Palmer, Birmingham (GB)

(73) Assignee: R. T. Palmer Ltd., Birmingham (GB)

( * ) Notice: Subject to any disclaimer, the term of this patent is extended or adjusted under 35 U.S.C. 154(b) by 0 days.

(21) Appl. No.: 09/674,914

(22) PCT Filed: May 7, 1999

(86) PCT No.: PCT/GB99/01445

§ 371 (c)(1),
(2), (4) Date: Jan. 2, 2001

(87) PCT Pub. No.: WO99/58093

PCT Pub. Date: Nov. 18, 1999

(30) Foreign Application Priority Data

May 8, 1998 (GB) ..... 9809755

(51) Int. Cl.[7] ..... A61H 3/04

(52) U.S. Cl. ..... 280/87.021; 280/87.041; 135/65; 135/67; 135/912

(58) Field of Search ..... 135/66, 67, 65, 135/912; 280/87.021, 87.02, 87.05, 87.041; 297/5; 403/52, 53, 83, 84, 86, 91, 99, 119; 482/66, 69

(56) References Cited

U.S. PATENT DOCUMENTS

| | | | | | |
|---|---|---|---|---|---|
| 2,991,100 | A | * | 7/1961 | Vanwersch et al. | 403/91 |
| 4,211,426 | A | * | 7/1980 | Motloch | 280/87.041 |
| 5,275,426 | A | * | 1/1994 | Tankersley | 135/67 |
| 5,365,621 | A | * | 11/1994 | Blain | 5/83.1 |

(List continued on next page.)

FOREIGN PATENT DOCUMENTS

| | | | | |
|---|---|---|---|---|
| CH | 000624357 A1 | * | 11/1994 | 135/67 |
| DE | 94 18 858 | | 5/1996 | |
| GB | 2 231 500 | | 11/1990 | |
| GB | 2 284 768 | | 6/1995 | |
| JP | 05123534 | * | 4/1993 | 135/66 |

*Primary Examiner*—Brian L. Johnson
*Assistant Examiner*—Kelly E Campbell
(74) *Attorney, Agent, or Firm*—Venable LLP; Robert Kinberg; Stuart I. Smith

(57) ABSTRACT

An orthotic walker comprises an orthosis (60) mounted on a wheeled frame (10) which includes a first or rearward transverse frame member (11) having thereon an attachment device (17) for releasably mounting a support member (20) adapted to carry said orthosis (60) and a connection assembly (13, 33) for the releasable connection of forwardly extending lateral frame members (30) with an optional removable forward transverse frame member (50). The first frame member (11) carries a pair of laterally spaced wheels (16) and the lateral frame members (30) each carry a further wheel (41) at the forward end thereof. Several interchangeable lateral frame members (30, 30A) are provided whereby the overall width of the frame (10) can be varied by selecting lateral frame members (32, 32A) of differing size. The support member (20) which carries the orthosis (60) is one of a plurality of interchangeable support members (20, 20A) provided in a range of sizes to suit patients of differing height and weight. The orthosis (60) comprises a back member (61) carrying a pair of lateral arms (64) mounted adjustably thereon, and each said arm (64) includes a pivotal mounting (65) by means of which a respective leg support (70) is suspended. Each leg support includes an upper element (74) having a pivotal mounting (71) at its upper end whereby it is connected to a back support, a lower element (75) having a foot support member (100) at its lower end, and an intermediate pivotal connection (72) whereby the upper and lower elements are connected to one another, wherein the upper and lower elements (74, 75) of the leg supports (70) are releasably and adjustably secured to the upper pivotal mounting (76), to the intermediate pivotal connection (72) and to the foot support member (100), so that the effective length of each of said elements can be adjusted independently.

39 Claims, 11 Drawing Sheets

Figure 1:
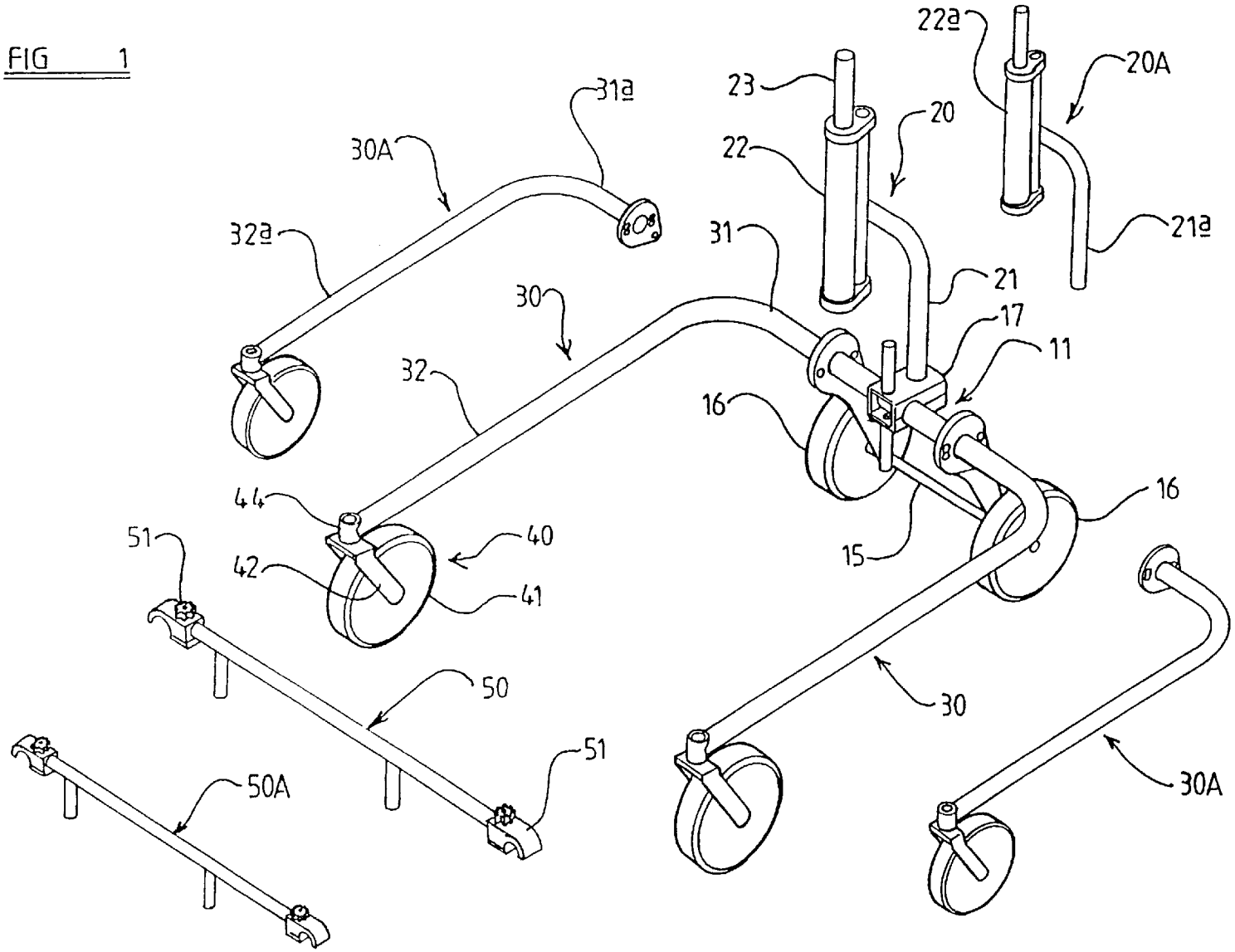

U.S. PATENT DOCUMENTS 5,405,347 A * 4/1995 Lee et al. ..... 403/103
5,427,438 A * 6/1995 Fochs ..... 135/67
5,467,793 A 11/1995 Hart
5,538,268 A * 7/1996 Miller ..... 280/87.041
5,588,456 A * 12/1996 Hart ..... 135/66
5,620,272 A * 4/1997 Sheng ..... 182/163
5,676,388 A * 10/1997 Bertani ..... 280/250.1
5,803,103 A * 9/1998 Haruyama ..... 135/67

* cited by examiner

ORTHOTIC WALKER

BACKGROUND OF THE INVENTION

This invention relates to an orthotic walker, that is to say a device comprising an orthosis for supporting and controlling at least the legs, and optionally also the upper body, of a patient suffering from conditions such as cerebral palsy or other similarly debilitating conditions, and a wheeled frame on which the orthosis is mounted to provide support for the orthosis and the patient.

Existing orthotic walkers have various drawbacks and the object of the invention is to provide an improved orthotic walker having advantages as hereinafter explained.

SUMMARY OF THE INVENTION

Terms, such as "transverse," "lateral," "front" and "rear" as used herein are, unless the context requires otherwise, intended to indicate a direction relative to a normal walking direction of the device as in use.

According to a first feature of the invention, I provide an orthotic walker comprising an orthosis mounted on a wheeled frame, wherein the wheeled frame comprises a first frame member which extends generally in a direction transverse to the normal walking direction when in use and having thereon attachment means for releasably mounting a support member adapted to carry said orthosis and connection means for the releasable connection of lateral frame members at opposite ends of the first frame member.

The construction of the frame in this way enables different sizes of support member and of lateral frame members to be attached to the first frame member in order to adapt the walker for patients of differing height and/or weight or to adapt to the changing requirements of a growing patient.

In a preferred arrangement the first frame member carries a pair of laterally spaced wheels and said connection means are disposed outwardly thereof, and in this case the lateral frame members each carry a further wheel at or adjacent to the end thereof remote from said connection means.

Further wheels may be castor wheels adapted to swivel about an upright axis, whereas the wheels on or adjacent to the first frame member are preferably non-swivelling. Where such castor wheels are provided, preferably they include adjustable means for restricting the degree of swivelling allowed.

However, it would alternatively be possible for the lateral frame members to carry a respective wheel at or adjacent to the end thereof at which it is connected to the first frame member, in addition to, or instead of, the wheels carried by the first frame member.

The connection means for the lateral frame members conveniently comprises two or more headed studs which project in the transverse direction at each end of the first frame member at equal angular spacings about a transversely extending axis of rotation, and each of said lateral frame members includes a mounting plate having a number of key-hole slots corresponding to said studs, whereby wider end portions of said key-hole slots can be passed over the respective studs and the mounting plate rotated to engage said studs in narrower end portions of said slots.

The wheels carried by, or adjacent to, the first frame member are preferably carried at the outer ends of respective arms at positions spaced from the first frame member in a direction perpendicular to the transverse direction so that when the wheels are engaged with the floor to support the walker a turning moment is applied to the arms, and the arrangement is such that the turning moment acts to assist retention of the studs in the narrower ends of the slots. However, a locking fastener may additionally be provided to hold the mounting plate in assembled relation with the first frame member.

The frame may additionally include a further transversely extending frame member which is releasably connectable to said lateral frame members at or near the ends thereof remote from their connection with said first frame member.

Normally the first frame member will define the rear part of the frame and the lateral frame members will extend forwardly therefrom with the further frame member connected at the forward ends thereof. The releasable connection of the further frame member at the forward side of the frame facilitates the location of the patient in the walker with this frame member removed and subsequently replaced.

In a preferred arrangement, each of the lateral frame members includes a transverse part whereby it is connected to the first frame member and a forwardly extending part. In this way the overall width of the frame can be varied by selecting lateral frame members having a transverse part of differing length.

Whilst it is particularly beneficial for the forward frame member to be releasable, it would alternatively be possible to utilise a single U-shaped frame member instead of separate lateral frame members with a removable forward transverse frame member.

The support member which carries the orthosis may be provided in a range of sizes to suit patients of differing height and weight, and preferably includes a linear suspension unit carried at the upper end of a generally upright arm. The suspension unit may comprise a rod guided for movement in a generally vertical direction under the control of a spring, and the orthosis may be releasably connectable to said rod.

The orthosis may comprise a back member having a mounting means thereon whereby it is releasably connectable to said rod of the suspension unit. The mounting means may be pivotally secured to said back member so as to allow the latter to tilt about a generally horizontal axis and may include a tubular fitting adapted to be engaged slidably over an end portion of said rod.

The back member may carry a pair of lateral arms mounted adjustably thereon, each arm including a transversely extending portion and a forwardly extending portion having a free end at which a respective leg support is pivotably suspended. Such leg supports each comprise an upper element having a pivotal mounting at its upper end whereby it is connected to one of said arms, a lower element having a foot support member at its lower end, and an intermediate pivotal connection whereby the upper and lower elements are connected to one-another.

In accordance with a further feature of the invention, the upper and lower elements of the leg supports are releasably and adjustably secured to the upper pivotal mounting, intermediate pivotal connection and foot support member, so that the effective length of each of said elements can be adjusted independently.

In a preferred arrangement, each of said elements comprises a bar and end portions thereof are connected in overlapping relationship with the upper pivotal mounting, the intermediate pivotal connection and the foot support member as appropriate, for example by means of clamping plates.

The upper pivotal mounting acts as a hip-joint and preferably incorporates means for adjustment of the abduction/ aduction angle at the joint. Such means, in accordance with a further feature of the invention, comprises a gimbals assembly including a block mounted for pivotal movement about a first generally horizontal axis and defining a second generally horizontal axis orthogonal thereto, a pivot pin centred on said second axis and carrying said upper pivotal mounting, and adjustment screws carried by said block and engaging with said upper pivotal mounting so as to enable the latter to be set in any of a plurality of positions of angular adjustment relative to a line orthogonal to the first and second axes.

In accordance with a further feature of the invention, the foot support means includes a shoe clamp carried by a pivotal joint with a restricted and adjustable range of pivotal movement to provide control over the degree of dorsiflexion and plantiflexion at the ankle of the user. This joint may comprise an upper arm which is connected to the lower element of the leg support, and lower arm which carries the shoe clamp, and a pivotal connection between said upper and lower arms, wherein the range of pivotal movement is limited and adjustable. The range of movement may be limited by pins which extend through overlapping arcuate slots formed in said arms and the effective length of overlap of said slots is adjustable. In an alternative arrangement, the range of movement permitted to the lower arm relative to the upper arm may be controlled by means of a stop block which is mounted on the upper arm and engages in a recess formed at the upper end of the lower arm to limit angular movement at the joint. The stop block may be adjustable in position relative to the upper arm, for example by being reversible through 180° and may have a wider end and a narrower end, either of which can be arranged to engage in the recess so as to provide for two different ranges of movement. It will be appreciated that it would be possible to provide other interchangeable stop blocks to afford different ranges of movement, of to provide a modified stop block with more than two end portions, e.g. three of four, by forming the block with three or four arms.

A further feature of the invention relates to the shoe clamp, which may comprise a mounting arm which is releasably connectable to said lower arm of said pivotal joint at the user's ankle, a support bar which extends transversely from said mounting arm, a bracket at a free end of said support bar adapted to engage over the welt of a shoe worn by the user, and an adjustable clamp carried by said mounting arm to engage on the welt of the user's shoe at the side thereof opposite said bracket.

A further form of shoe clamp in accordance with the invention comprises a mounting arm which is releasably connectable to said lower arm of said pivotal joint at the user's ankle, a support bar which extends transversely from said mounting arm, brackets at opposite ends of said support bar having flanges adapted to engage over the welt of a shoe worn by the user, and an adjustable member carried by said support bar for movement in a direction towards and away from said flanges to clamp against the underside of the user's shoe.

The invention further resides in a wheeled frame for carrying an orthosis (60) to provide a controlled walking facility when the orthosis is mounted on the frame, wherein the wheeled frame comprises a first frame member which extends generally in a direction transverse to the normal walking direction when in use and having thereon attachment means for releasably mounting a support member adapted to carry said orthosis and connection means for the releasable connection of lateral frame members at opposite ends of the first frame member.

The invention also resides in an orthosis for use with a wheeled frame and having a pair of leg supports each of which includes an upper element having a pivotal mounting at its upper end whereby it is connected to a back support, a lower element having a foot support member at its lower end, and an intermediate pivotal connection whereby the upper and lower elements are connected to one-another, wherein the upper and lower elements of the leg supports are releasably and adjustably secured to the upper pivotal mounting, to the intermediate pivotal connection and to the foot support member, so that the effective length of each of said elements can be adjusted independently.

BRIEF DESCRIPTION

Figure 2:
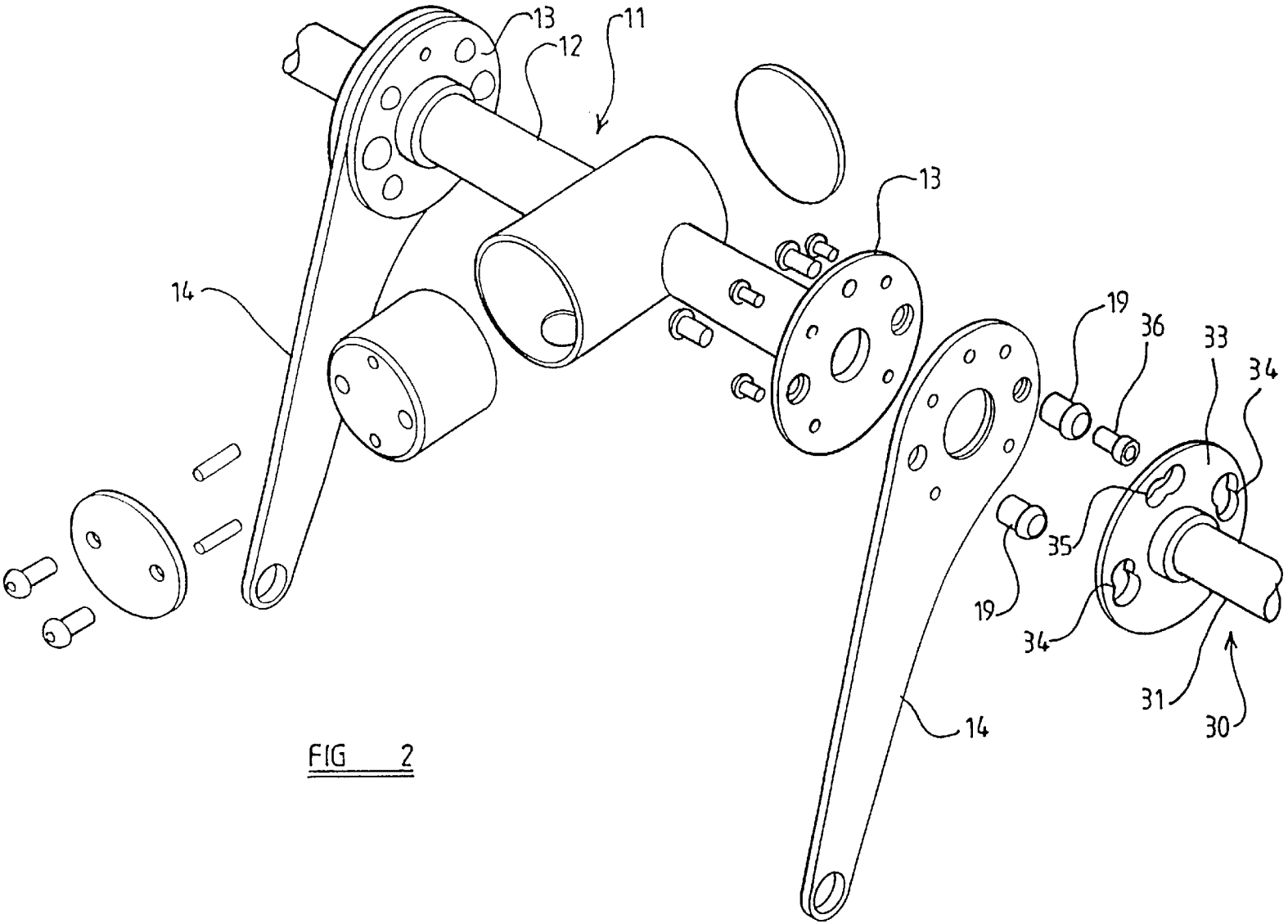
Figure 3:
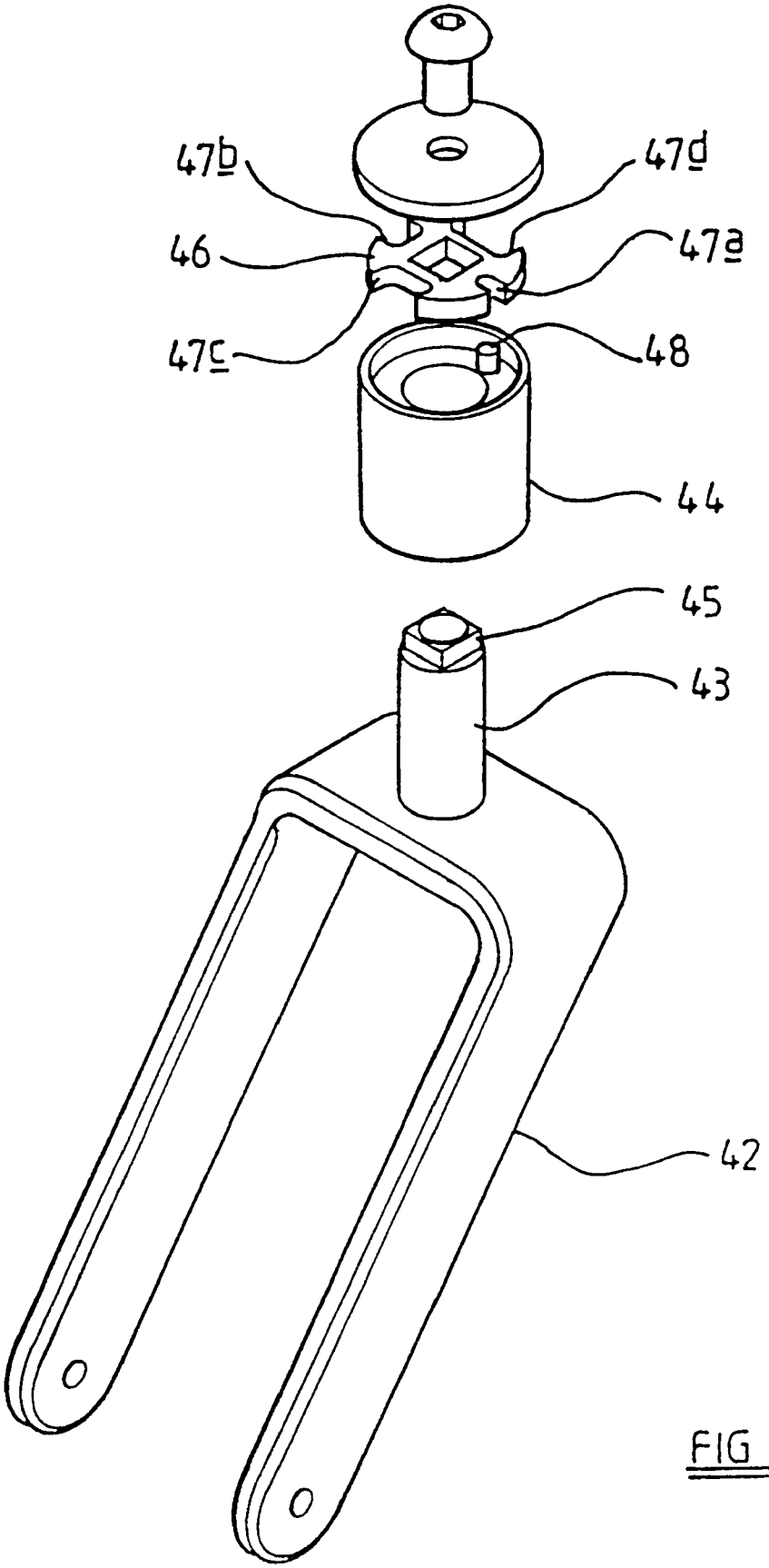
Figure 4:
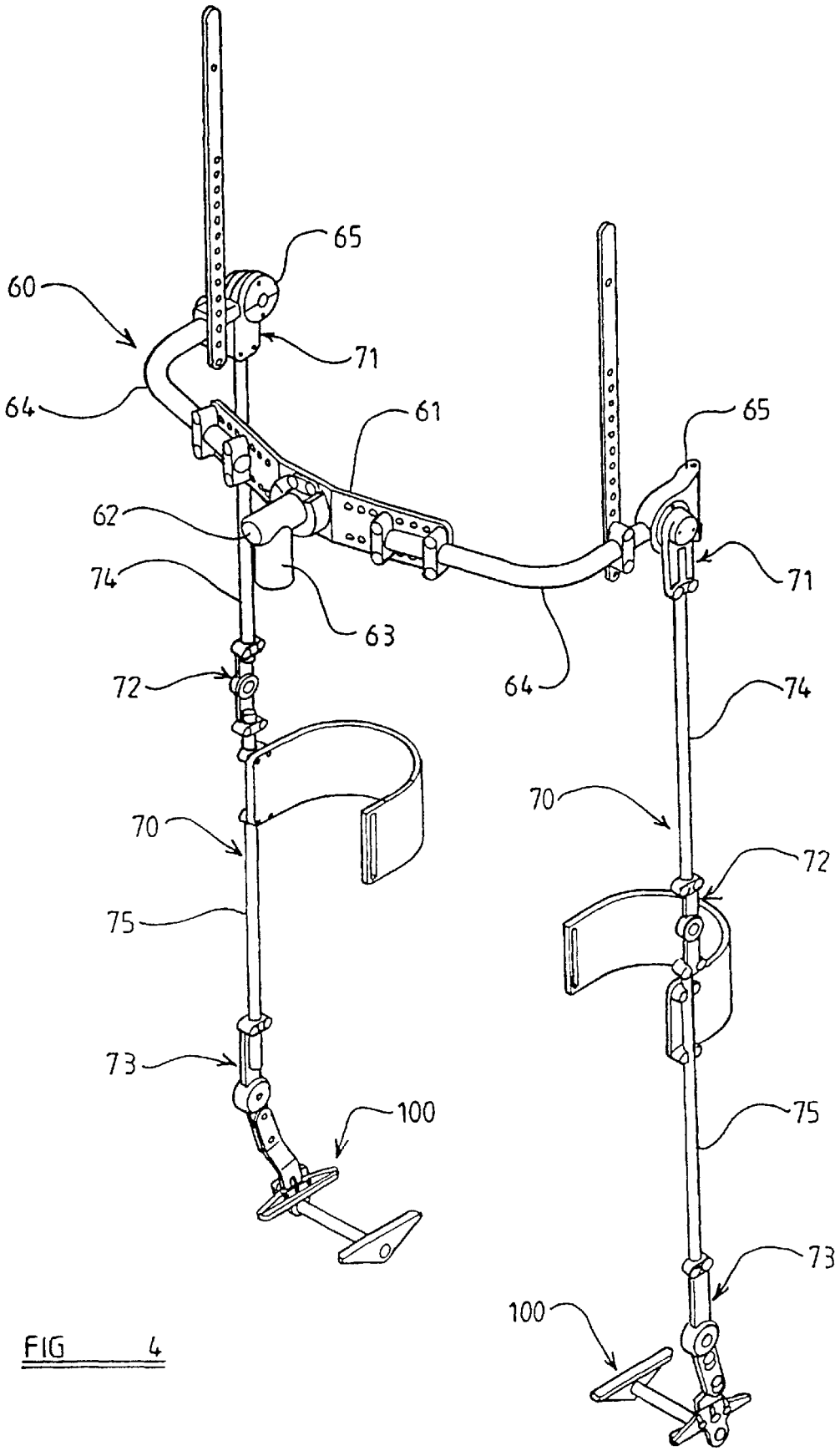
Figure 5:
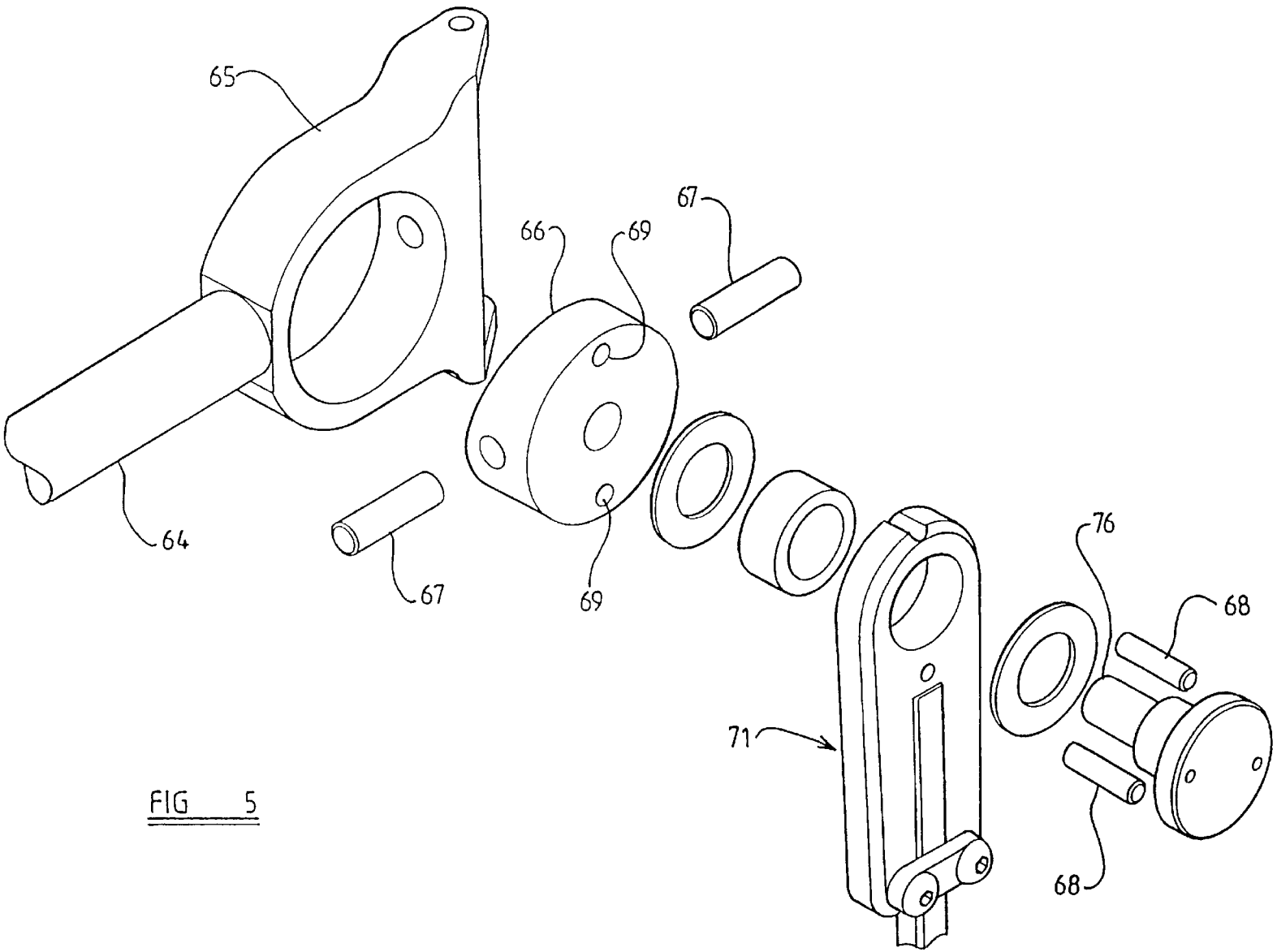
Figure 6:
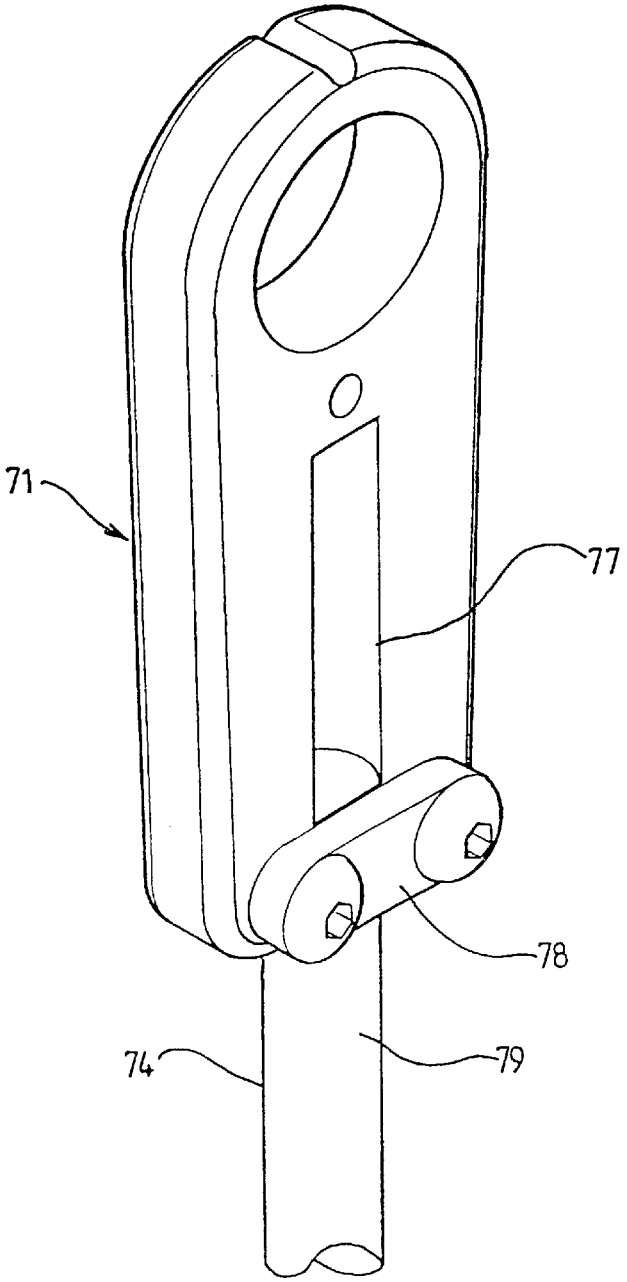
Figure 7:
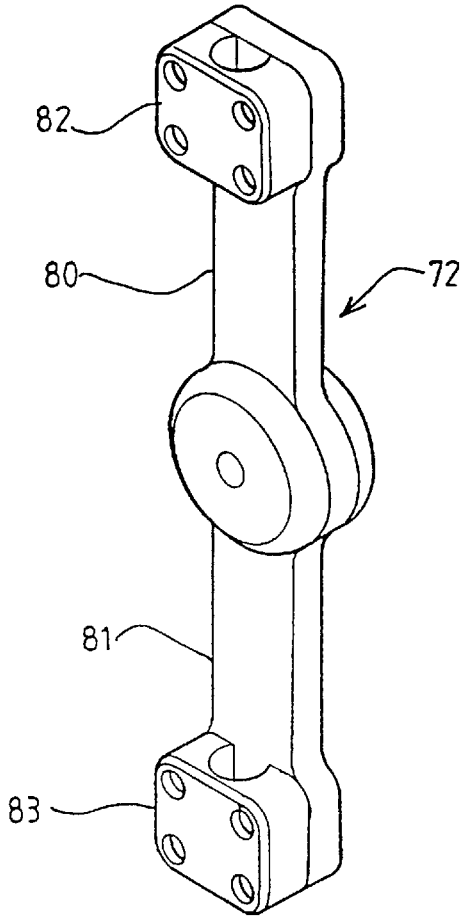
Figure 8:
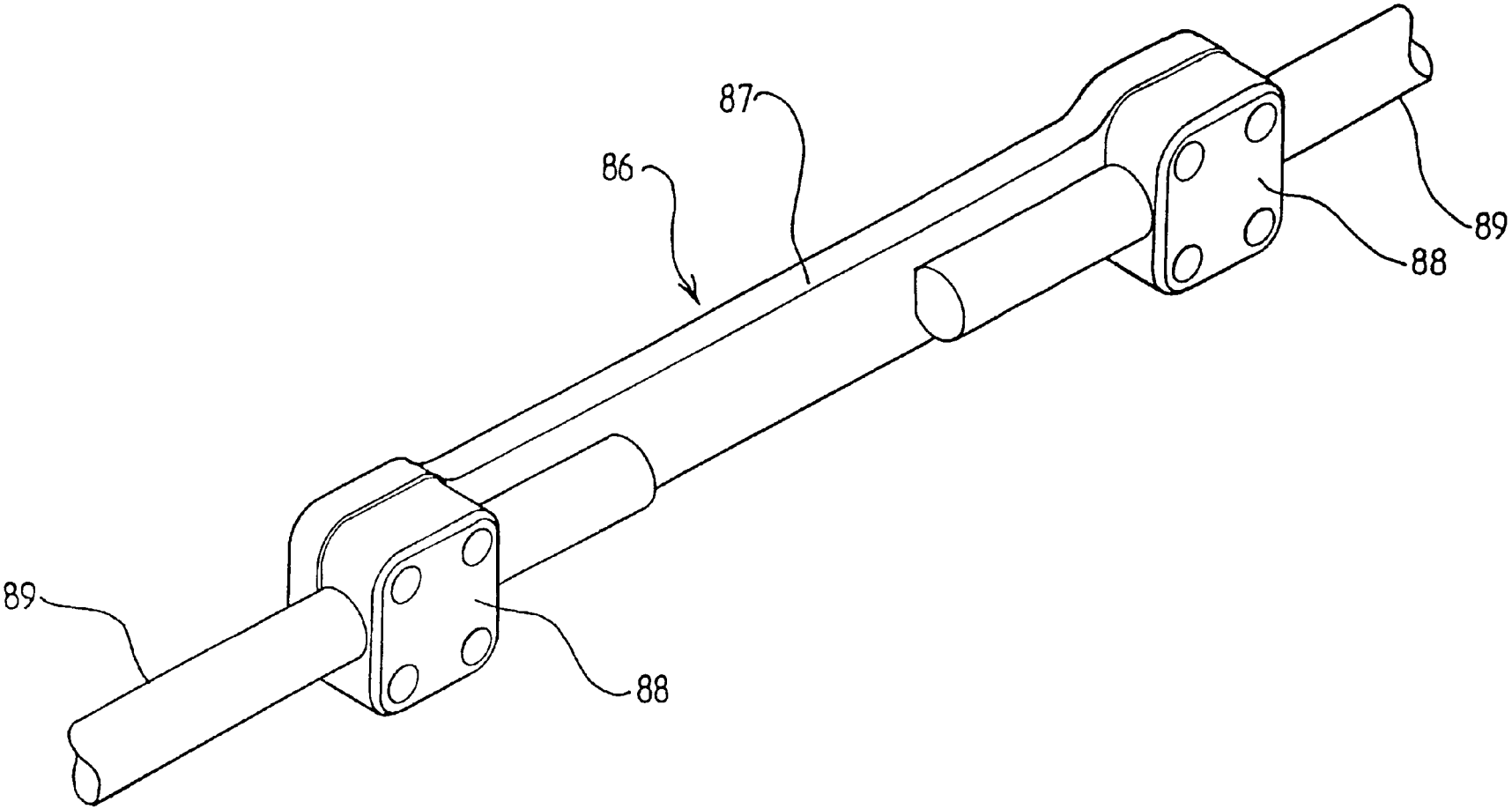
Figure 10:
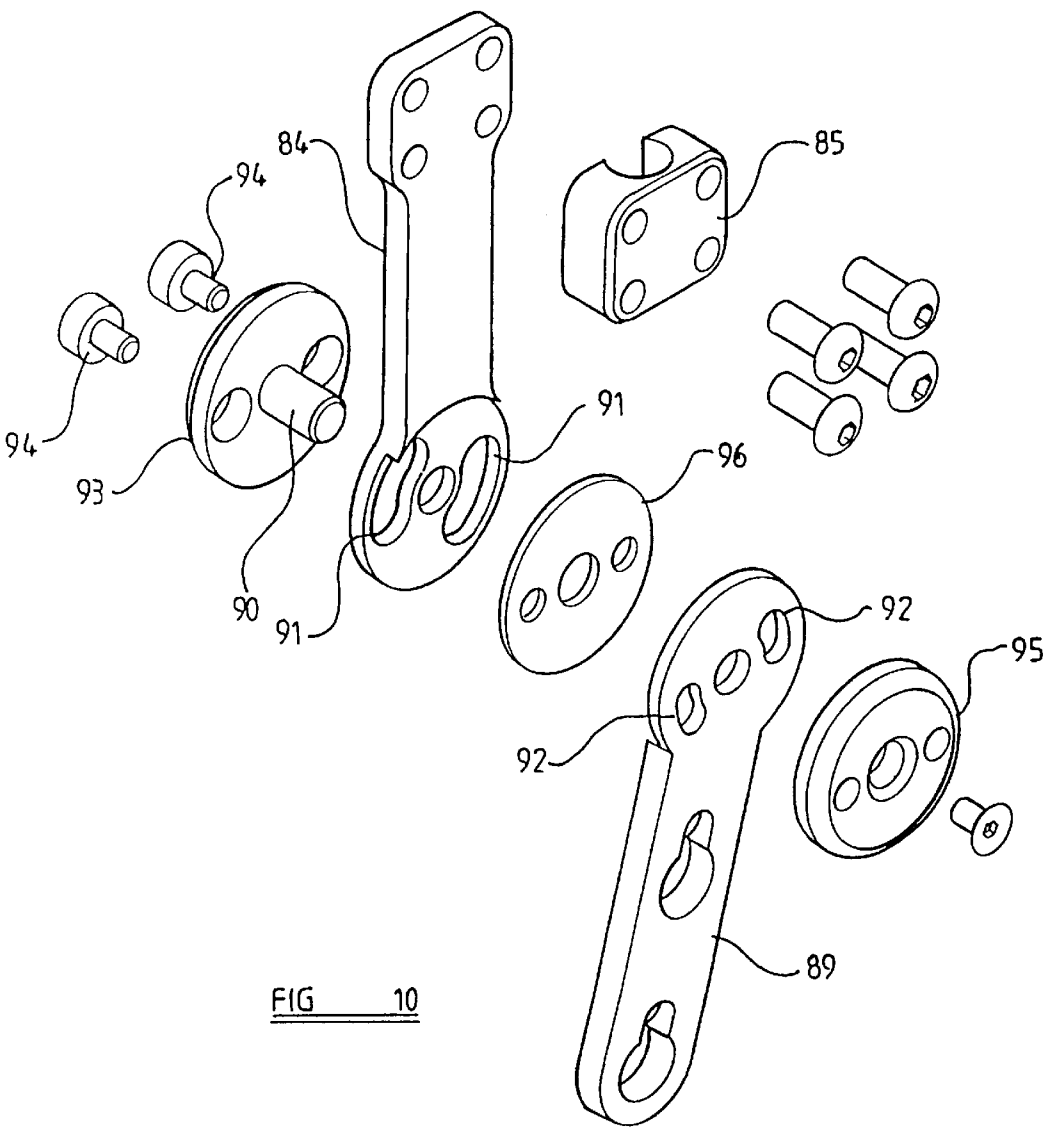
Figure 9:
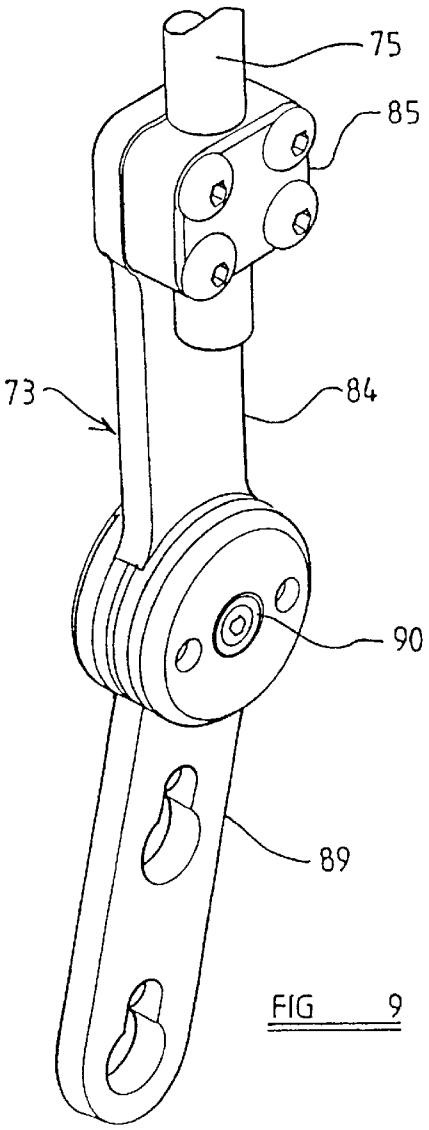
Figure 12:
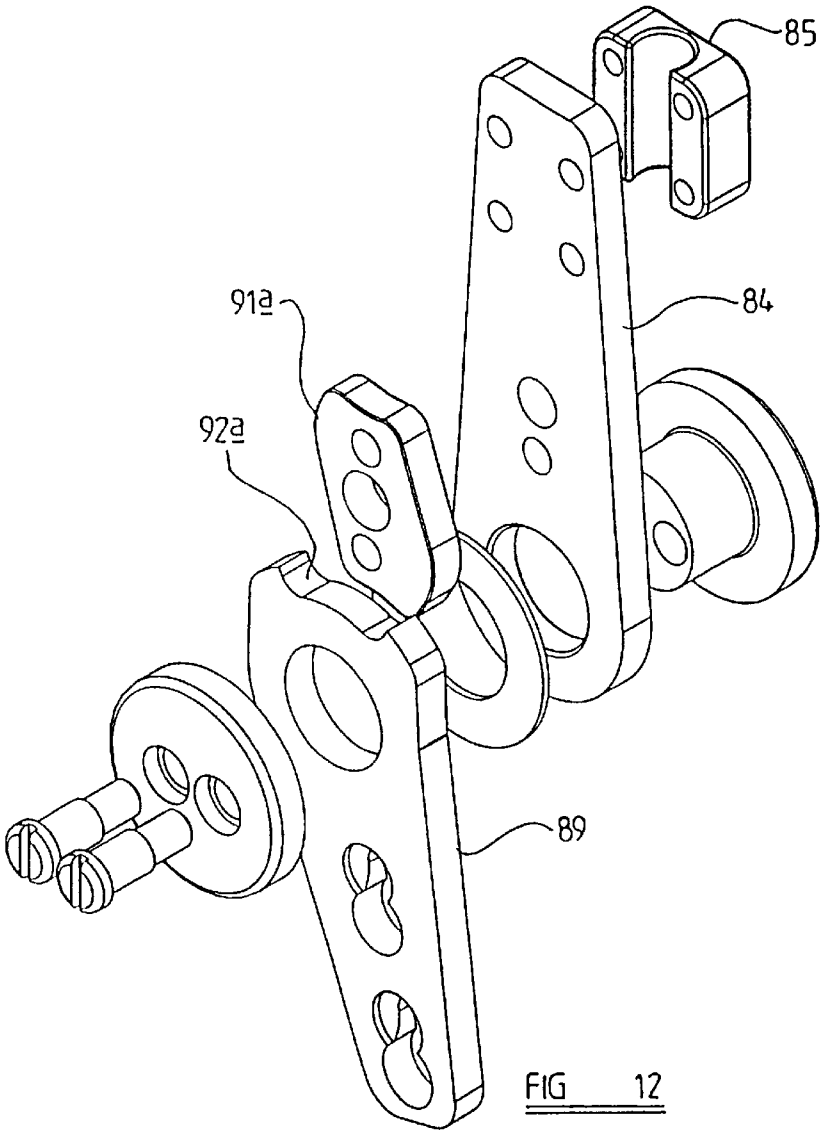
Figure 11:
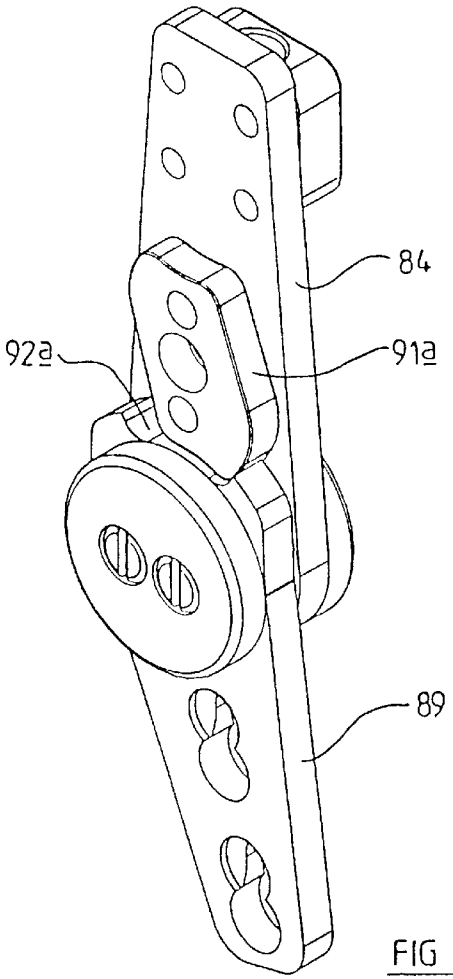
Figure 14:
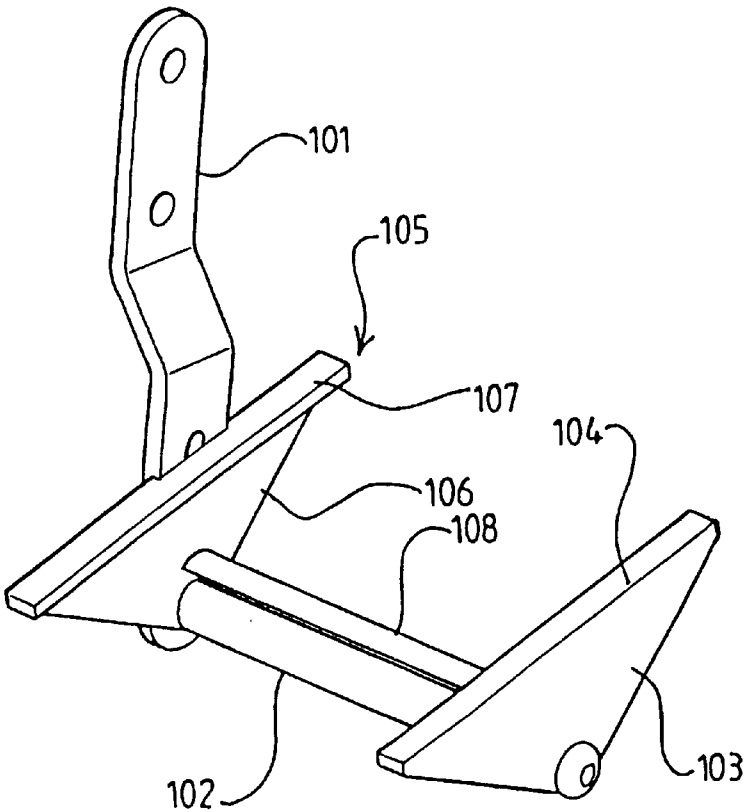
Figure 13:
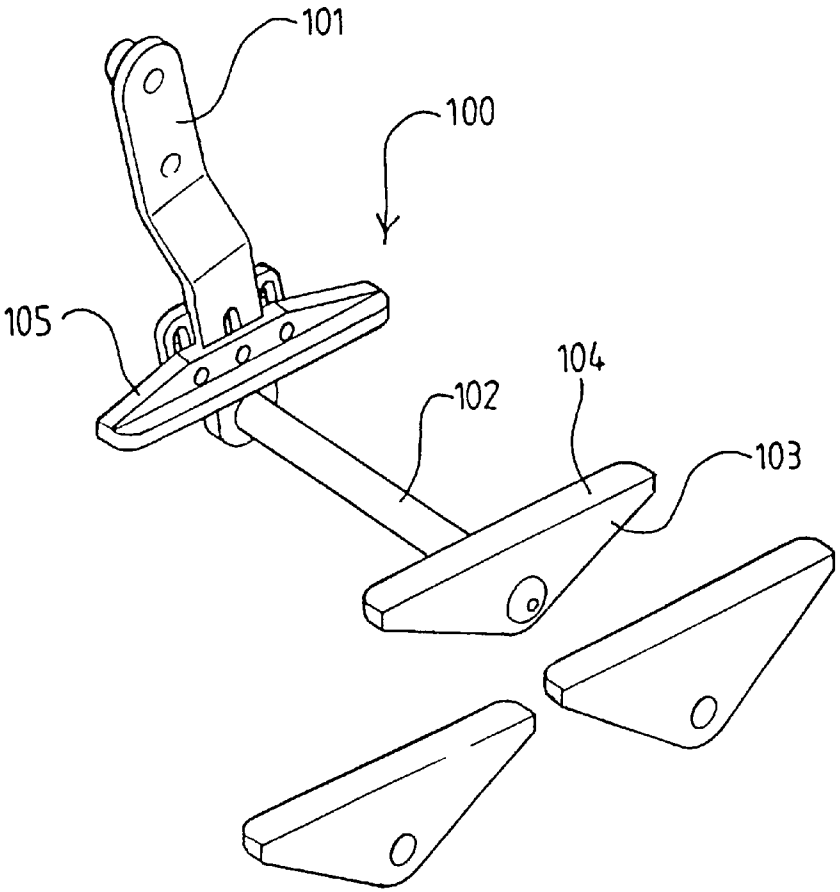
Figure 15:
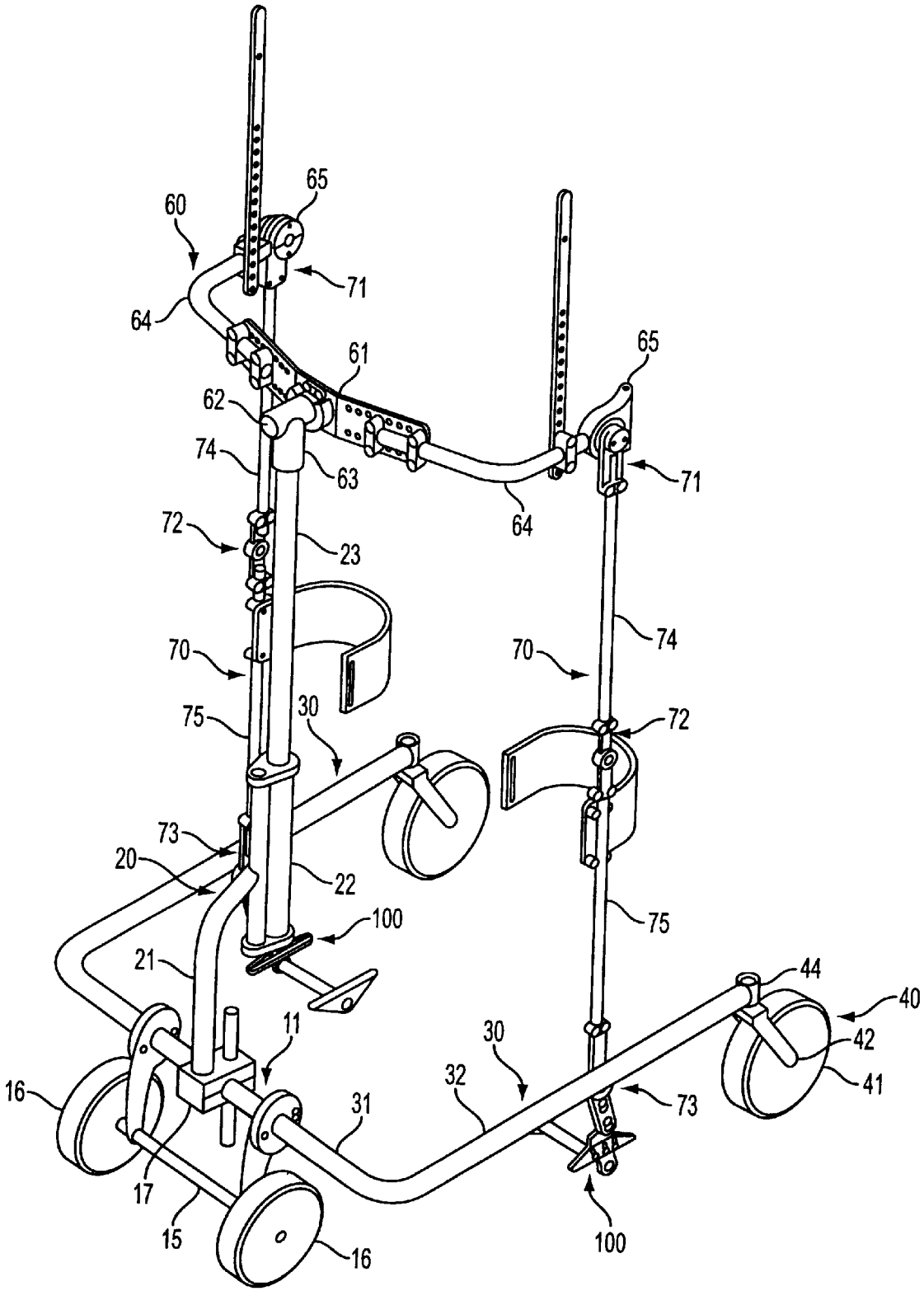

These and other features of the invention will now be described by way of example with reference to the accompanying drawings wherein:

FIG. 1 shows one embodiment of wheeled frame with a number of alternative and interchangeable components, FIG. 2 shows connections between a transverse member of the frame and lateral members of the frame, one such connection being shown in "exploded" form, FIG. 3 shows, in "exploded" form an arrangement for imposing a variable restriction on the swivelling action of castor wheels provided at the forward end of the frame, FIG. 4 shows an orthosis of the kind for assembly with the frame, FIG. 5 shows, in "exploded" form of a hip-joint of a leg support forming part of the orthosis, FIG. 6 shows an adjustable connection at the upper end of the leg support, FIG. 7 shows a knee-joint of the leg support, FIG. 8 shows an adjusting assembly which is used to determine the required length of upper and lower elements of the leg support, FIG. 9 shows an adjustable connection at the lower end of the leg support and an ankle-joint, FIG. 10 shows the ankle-joint in "exploded" form, FIG. 11 shows an alternative form of ankle-joint, FIG. 12 shows the alternative ankle-joint in "exploded" form, FIG. 13 shows one form of foot support provided at the lower end of the leg support, FIG. 14 shows an alternative form of foot support, and FIG. 15 shows a combination of an orthosis and a wheeled frame.

DETAILED DESCRIPTION OF THE INVENTION

As shown in FIG. 1, an orthotic walker in accordance with the invention comprises a wheeled frame 10 formed from a number of interconnectable and interchangeable frame members whereby the frame can be adapted readily to support users of differing weights and sizes. As illustrated, the frame 10 comprises a first frame member 11 which forms the rear part of the frame and extends generally transversely relative to the in-use direction of forward advancement. The rear frame member includes a tube 12 which has secured at the ends thereof respective discs 13. Rearwardly and downwardly inclined arms 14 are secured: at the outer faces of the discs 13 by means of screws or other suitable fastening elements. At their lower ends, the arms 14 support a transversely extending axle 15 which carries a pair of rear wheels 16 at positions disposed outwardly of the arms 14.

Centrally of its length, the tube 12 caries a mounting assembly 17 for a support member 20 which comprises an upright stem 21 which is adapted to be releasably secured to the mounting assembly 17 in any suitable manner. The upper end of the stem 21 curves forwardly and carries a vertically arranged linear suspension unit 22 having a vertically projecting rod 23 which is movable under the control of spring means (not shown).

The frame 10 further comprises a pair of lateral frame members 30, each of which includes a transversely extending portion 31 and a forwardly extending portion 32. The free end of the transversely extending portion 31 of each lateral frame member 30 carries a disc 33 formed with a pair of diametrically opposed key-hole slots 34 adapted to receive headed studs 19 carried by the assembly of disc 13 and arm 14 of the rear frame member 11 whereby the lateral frame members 30 are releasably secured to the rear frame member 11.

It will be understood that because the arms 14 are directed rearwardly, the weight of the walker applies a turning moment at the upper ends of the arms, and the key-hole slots 34 are oppositely directed so that such turning moment acts to assist the retention of the studs 19 in the narrower ends of the slots 34.

However, additionally, the disc 33 is formed with a further slot 35 for the reception of a clamping screw 36 to secure the discs 13 and 33 together securely.

At their forward ends, the lateral frame members 30 carry respective castor wheel assemblies 40, each comprising a wheel 41 mounted for rotation on a pair of forks 42 with a vertical pivot pin 43 which defines a swivelling axis. The pivot pin 43 is located in a bearing sleeve 44 secured to the forward end of the forwardly extending portion 32 of the lateral frame member 30. Whilst the wheels 42 may be freely swiveallable about the vertical axis defined by the pivot pins 43, in accordance with a preferred feature of the invention means is provided to restrict such swivelling movement.

For this purpose, and as shown in FIG. 3, the pivot pin 43 is formed at its upper end with a square spigot 45 on which a control disc 46 is located. In the illustrated embodiment, the control disc 46 is formed with four recesses 47*a*, 47*b*, 47*c* and 47*d* of differing peripheral lengths. A peg 48 is carried by the sleeve 44, and the control disc 46 can be assembled with the spigot 46 in any of four different positions so that one of the four recesses receives the peg 48. The recess 47*a* is so dimensioned as to prevent the disc 46 turning, thereby holding the forks 42 in a fixed position, whereas recesses 47*b*, 47*c* and 47*d* allow progressively increasing ranges of swivelling movement.

The frame 10 preferably also includes a removable cross-member 50 which can be secured between the lateral frame members 30 at a position adjacent the forward ends thereof. For this purpose, the cross-member 50 is provided with clamps 51 which are adapted to grip the tubular forwardly extending portions 32 of the lateral frame members.

The cross-member 50 may carry a pair of rollers 52 for guide straps associated with leg supports included in the orthosis as hereinafter described, and one or more further rollers, for example as shown at 18 in FIG. 1, may be provided on the rear frame member 11 for the same purpose.

In order to construct several different sizes of wheeled frame, additional lateral side members, such as shown at 30A are provided, and these may be interchanged with the lateral frame members 30 by virtue of the releasable connection afforded by the headed studs 19 carried by the first frame member 11. As illustrated, the alternative lateral frame members 30A include transversely extending portions 31*a* and forwardly extending portions 32*a* which are shorter than the corresponding portions of the lateral frame members 30. In a similar manner, further lateral frame members of increased or reduced dimensions may be provided. Similarly, further cross-members, such as the cross-member 50A may be provided, with lengths appropriate to the spacing between the different sets of lateral frame members. Alternatively, the cross-member 50 may itself be constructed so as to be adjustable in length.

Likewise, an alternative support member 20A may be provided, having a stem 21*a* which is shorter or longer than the stem 21 of the support member 20, and with a suspension unit 22*a* having a different range of travel and/or different spring characteristics.

Whilst the embodiment illustrated has the rear wheels 16 carried by the rear frame member 11, it will be appreciated that it would alternatively be possible for the rear wheels to be carried in a similar manner by the lateral frame members 30 in a similar position. In further variations, the rear frame member may be wider than illustrated, and the lateral frame members could then simply extend forwardly, instead of having transversely extending portions, and such modified lateral frame members could then be connected releasably to the rear frame members in the same manner as the cross-member is connected to the lateral frame members.

The walker further comprises an orthosis 60 which, in the embodiment illustrated in FIGS. 4 to 12, includes a back member 61 which extends transversely and centrally thereof has pivotally connected thereto a mounting member 62 which includes a downwardly directed hollow spigot 63 so dimensioned as to fit over the upper end of the rod 23 of the suspension unit 20 so that after the orthosis is fitted to the user, the user and the orthosis can be lifted into the frame to locate the spigot 63 onto the rod 23.

At each end the back member 61 carries adjustably secured thereto respective lateral arms 64 which curve forwardly and carry at their forward ends pivotal mountings 65 for leg support assemblies 70.

Each leg support assembly 70 comprises an upper, hip-joint member 71, an intermediate, knee-joint member 72 and a lower, ankle-joint member 73, interconnected by upper and lower leg bars 74 and 75.

The hip-joint member 71 swings freely on a pivot pin 76 which is carried by a gimbals assembly comprising a gimbals block 66 which is mounted on pivot pins 67 in the mounting 65 for movement about a forwardly extending horizontal axis.

Adjuster pins 68 enter threaded bores 69 in the gimbals block 66 and at their outer ends bear against the inwardly presented side face of the hip joint member 71 so as to provide for variation of the abduction/aduction angle of the joint.

The hip-joint member 71 is formed with a longitudinally extending groove 77 which slidably receives the upper end portion of the upper leg bar 74, and has an associated clamping plate 78 whereby the leg bar 74 may be secured to the hip-joint member 71 in a range of positions of longitudinal adjustment relative to the axis defined by pivot pin 76.

Whilst the leg bars may be of square-shape in transverse section, in the illustrated embodiment they are of circular section with a flat, outwardly presented face 79 which co-operates with the flat clamping plate 78, and the groove 77 is correspondingly of part-circular form in section.

The knee-joint 72 comprises pivotally connected arms 80,81 which carry at their outermost ends clamping blocks 82,83 to receive respectively the lower end of the upper leg bar 74 and the upper end of the lower leg bar 75 in a longitudinally adjustable manner.

The ankle-joint 73 likewise includes an upper arm 84 which carries a clamping block 85 whereby it is adjustably secured to the lower end of the lower leg bar 75.

In this way, the distance between the pivotal axes of the hip, knee and ankle-joints can be adjusted individually to suit specific users, both when they are initially fitted with the orthosis, and also to accommodate any subsequent growth. The leg bars 74,75 can be cut to any required length from stock material, and the adjustment available at each end of each leg bar can be in the region of 5 cm so that, using the same set of leg bars, a total length adjustment up to about 20 cm can be achieved for the entire leg support.

In order to determine precisely the required length of the leg bars 74,75, an adjuster assembly 86, as shown in FIG. 8, ay be used. This comprises a link 87 having at each end a respective clamping block 88 for the reception of a respective rod 89, which may comprise material the same as that from which the leg bars are cut. In use, the required spacing between the users hip and knee-joint, or between the user's knee and ankle-joint can be determined by adjusting the rods 89 relative to the link 87 against the user's body, and then cutting a length of the leg bar material to the required dimension to serve as the upper leg bar 74 or lower leg bar 75 as appropriate.

The ankle-joint member 73 also includes a lower arm 89 which is pivotally connected to the upper arm 84 by means of a pivot pin 90.

The angular range of movement of the lower arm 89 relative to the upper arm 84 is adjustable by virtue of pairs of arcuate slots 91 formed in a lower end portion of the upper arm 84 and arcuate slots 92 formed in an upper end portion of the lower arm 89, the slots being centred on the axis of the pivot pin 90.

The pivot pin 90 is carried by an end plate 93 which is secured by means of headed screws 94 to a further end plate 95 with the interposition of a spacer plate 96, and the end portions of the arms 84,89 are disposed between the plates 93,95,96 as shown in FIG. 10. The shanks of the headed screws 94 pass through the arcuate slots 91 and 92 in the end portions of the arms, and the upper and lower arms 84,89 can be secured together in a range of angular positions by slackening off the screws 94, and adjusting the lower arm 89 angularly relative to the upper arm 84 before re-tightening the screws 94.

The alternative form of ankle joint member 73A as shown in FIGS. 11 and 12 is of generally similar construction and similar parts are designated by the same reference numerals. However, in this case the range of movement permitted to the lower arm 89 relative to the upper arm 84 is controlled by means of a stop block 91*a* which is mounted on the upper arm 84 and engages in a recess 92*a* formed at the upper end of the lower arm 89 to limit angular movement at the joint. The stop block 91*a* is reversible through 180° and has a wider end and a narrower end, either of which can be arranged to engage in the recess 92*a* so as to provide for two different ranges of movement. It will be appreciated that it would be possible to provide other interchangeable stop blocks to afford different ranges of movement, of to provide a modified stop block with more than two end portions, e.g. three of four, by forming the block with three or four arms.

The lower arm 89 of the ankle joint member 73 or 73A carries a shoe clamp assembly 100 which is releasably connectable thereto. The shoe clamp assembly 100 comprises a mounting arm 101 have at its lower end a transversely extending support bar 102, and the latter at its free end carries a bracket 103 having an inwardly directed flange 104 which is adapted to engage over the upper edge of the welt of a user's shoe when the shoe rests on the support bar 102. The mounting arm 101 also carries a vertically adjustable clamping member 105 to engage the welt of the user's shoe at the side thereof opposite the bracket 103. Different sizes of bracket may be provided for interchangeable assembly with the support bar 102 to accommodate differing thickness of welt.

An alternative form of shoe clamp assembly as shown in FIG. 12 utilises a second bracket 106 with an inturned flange 107 in place of the adjustable clamping member 105, and in this case the support bar 102 carries a clamping plate 108 which is adjustable in a direction towards and away from the flanges 104,107 and is adapted to bear against the underside of the user's shoe, so as to draw the flanges 104,107 onto the welt on both sides of the shoe. Again interchangeable brackets of differing sizes may be provided for assembly with the support bar 102 as required.

FIG. 15 shows an example of a combination of the orthosis and the wheeled frame.

It will be understood that the orthosis 60 as illustrated and described above may be modified as necessary for individual patients, and may additionally include means for supporting the user's upper body and/or arms and/or head.

What is claimed is:

1. An orthotic walker comprising an orthosis (60) mounted on a wheeled frame (10), wherein the wheeled frame (10) comprises a first frame member (11) which extends generally in a direction transverse to the normal walking direction when in use and having thereon attachment means (17) for releasably mounting a support member (20) adapted to carry said orthosis (60) and connection means (13, 33) for the detachable connection of lateral frame members (30) at opposite ends of the first frame member (11) to permit the walker to be adapted to the requirements of a patient, wherein a plurality of interchangeable lateral frame members (30, 30A) are provided and each of the lateral frame members (30, 30A) includes a transverse part (31, 31*a*) whereby the lateral frame member is connected to the first frame member (11) and a forwardly extending part (32, 32*a*) whereby the overall width of the frame (10) can be varied by selecting lateral frame members (32, 32A) having a transverse part of differing length.

2. An orthotic walker according to claim 1, wherein the first frame member (11) carries a pair of laterally spaced wheels (16) and said connection means (13,33) are disposed outwardly thereof.

3. An orthotic walker according to claim 2 wherein the lateral frame members (30) each carry a further wheel (41) at or adjacent to the end thereof remote from said connection means (13,33).

4. An orthotic walker according to claim 3 wherein said further wheels (41) are castor wheels adapted to swivel about an upright axis.

5. An orthotic walker according to claim 4 wherein the wheels (16) carried by the first frame member (11) are non-swivelling.

6. An orthotic walker according to claim 3 wherein adjustable means (45–48) are provided for restricting the degree of swivelling allowed said castor wheels (41).

7. An orthotic walker according to claim 2 wherein the connection means (13,33) for the lateral frame members (30)

comprises two or more headed studs (19) which project in the transverse direction at each end of the first frame member (11) at equal angular spacings about a transversely extending axis of rotation, and each of said lateral frame members (30) includes a mounting plate (33) having a number of key-hole slots (34) corresponding to said studs (19), whereby wider end portions of said key-hole slots (34) can be passed over the respective studs (19) and the mounting plate (33) rotated to engage said studs in narrower end portions of said slots.

8. An orthotic walker according to claim 7 wherein the wheels (16) carried by the first frame member (11) are carried at the outer ends of respective arms (14) at positions spaced from the first frame member (11) in a direction perpendicular to the transverse direction so that when the wheels (16) are engaged with the floor to support the walker a turning moment is applied to the arms (14), and the arrangement is such that the turning moment acts to assist retention of the studs (19) in the narrower ends of the slots (34).

9. An orthotic walker according to claim 8 wherein a locking fastener is additionally provided to hold the mounting plate (33) in assembled relation with the first frame member (11).

10. An orthotic walker according to claim 1 wherein the lateral frame members (30) each carry a respective wheel at or adjacent to the end thereof at which it is connected to the first frame member (11), in addition to, or instead of, the laterally spaced wheels (16) carried by the first frame member (11).

11. An orthotic walker according to claim 1 wherein the wheeled frame (10) additionally includes a further transversely extending frame member (50) which is releasably connectable to said lateral frame members (30) at or near the ends thereof remote from their connection with said first frame member (11).

12. An orthotic walker according to claim 1 wherein said lateral frame members (30, 30A) are integrally interconnected by a transverse frame member at the ends thereof remote from said first frame member (11).

13. An orthotic walker according to claim 1 wherein the support member (20) which carries the orthosis (60) is one of a plurality of such support members (20,20A) provided in a range of sizes to suit patients of differing height and weight.

14. An orthotic walker according to claim 13 wherein the support member (20,20A) includes a linear suspension unit (22,22*a*) carried at the upper end of a generally upright arm (21,21*a*).

15. An orthotic walker according to claim 14 wherein the suspension unit (22) comprises a rod (23) guided for movement in a generally vertical direction under the control of a spring, and the orthosis (60) is releasably connectable to said rod (23).

16. An orthotic walker according to claim 1 wherein the orthosis (60) comprises a back member (61) having a mounting means (62,63) thereon whereby it is releasably connectable to said rod (23) of the suspension unit (20,20A).

17. An orthotic walker according to claim 16 wherein the mounting means (62,63) includes a tubular fitting (63) adapted to be engaged slidably over an end portion of said rod (23).

18. An orthotic walker according to claim 16 wherein the mounting means (62,63) is pivotally secured to said back member (61) so as to allow the latter to tilt about a generally horizontal axis.

19. An orthotic walker according to claim 16 wherein the back member (61) carries a pair of lateral arms (64) mounted adjustably thereon, and each said arm (64) includes a transversely extending portion, a forwardly extending portion, and at the forward end thereof a pivotal mounting (65) by means of which a respective leg support (70) is suspended.

20. An orthotic walker according to claim 19 wherein said leg supports (70) each comprise an upper element (74) having a pivotal mounting (71) at its upper end whereby it is connected to one of said lateral arms (64), a lower element (75) having a foot support member (100) at its lower end, and an intermediate pivotal connection (72) whereby the upper and lower elements are connected to one-another.

21. An orthotic walker according to claim 20 wherein the upper and lower elements (74,75) of the leg supports (70) are releasably and adjustably secured to the upper pivotal mounting (71), to the intermediate pivotal connection (72) and to the foot support member (100), so that the effective length of each of said elements can be adjusted independently.

22. An orthotic walker according to claim 21 wherein each of said upper and lower elements (74,75) comprises a bar and end portions thereof are connected in overlapping relationship with the upper pivotal mounting (71), the intermediate pivotal connection (72) and the foot support member (100) as appropriate.

23. An orthotic walker according to claim 22 wherein said bars include a flat face (79) at opposed ends thereof arranged to co-operate with clamping means provided on each of the upper pivotal mounting (65), the intermediate pivotal connection (72) and the foot support member (100) as appropriate.

24. An orthotic walker according to claim 19 wherein the upper pivotal mounting (65) which acts as a hip-joint incorporates means (66–71) for adjustment of the abduction/aduction angle at the joint.

25. An orthotic walker according to claim 24 wherein said abduction/subduction angle adjustment means comprises a gimbals assembly including a block (66) mounted for pivotal movement about a first generally horizontal axis and defining a second generally horizontal axis orthogonal thereto, a pivot pin (76) centred on said second axis and carrying said upper pivotal mounting (71), and adjuster screws (68) carried by said block (66) and engaging with said upper pivotal mounting (71) so as to enable the latter to be set in any of a plurality of positions of angular adjustment relative to a line orthogonal to the first and second axes.

26. An orthotic walker according to claim 19 wherein the foot support member (100) includes a shoe clamp (103, 105;103,107) carried by a pivotal ankle joint (73) with a restricted and adjustable range of pivotal movement to provide control over the degree of dorsiflexion and plantiflexion at the ankle of the user.

27. An orthotic walker according to claim 26 wherein the ankle joint (73) comprises an upper arm (84) which is connected to the lower element (75) of the leg support (70), and a lower arm (89) which carries the foot support means (100), and a pivotal connection (73) between said upper and lower arms, wherein the range of pivotal movement is limited and adjustable.

28. An orthotic walker according to claim 27 wherein said range of pivotal movement of the ankle joint (73) is limited by pins (94) which extend through overlapping arcuate slots (91,92) formed in said upper and lower arms (84,89) and the effective length of overlap of said slots (91,92) is adjustable.

29. An orthotic walker according to claim 27 wherein said range of pivotal movement of the ankle joint (73A) is limited by means of a stop block (91*a*) which is mounted on the upper arm (84) and engages in a recess (92*a*) formed at the upper end of the lower arm (89) to limit angular movement at the joint.

30. An orthotic walker according to claim 29 wherein the stop block (91*a*) is reversible through 180° and has a wider end and a narrower end, either of which can be arranged to engage in the recess (92*a*) so as to provide for two different ranges of movement.

31. An orthotic walker according to claim 30 wherein the stop block (91*a*) is one of a plurality of interchangeable stop blocks to afford different ranges of movement.

32. An orthotic walker according to claim 26 wherein the shoe clamp comprises a mounting arm (101) which is releasably connectable to said lower arm (89) of said pivotal ankle joint (73), a support bar (102) which extends transversely from said mounting arm (101), a bracket (103) at a free end of said support bar (102) adapted to engage over the welt of a shoe worn by the user, and an adjustable clamp (105) carried by said mounting arm (101) to engage on the welt of the user's shoe at the side thereof opposite said bracket (103).

33. An orthotic walker according to claim 26 wherein the shoe clamp comprises a mounting arm (101) which is releasably connectable to said lower arm (89) of said pivotal ankle joint (73), a support bar (102) which extends transversely from said mounting arm (101), brackets (103,106) at opposite ends of said support bar (102) having respective flanges (104,107) adapted to engage over the welt of a shoe worn by the user, and an adjustable member (108) carried by support bar (102) for movement in a direction towards and away from said flanges (103,107) to clamp against the underside of the user's shoe.

34. A wheeled frame (10) for carrying an orthosis (60) to provide a controlled walking facility when the orthosis is mounted on the frame, wherein the wheeled frame (10) comprises a first frame member (11) which extends generally in a direction transverse to the normal walking direction when in use and having thereon attachment means (17) for releasably mounting a support member (20) adapted to carry said orthosis (60) and connection means (13, 33) for the detachable connection of lateral frame members (30) at opposite ends of the first frame member (11) to permit the walker to be adapted to the requirements of a patient, wherein a plurality of interchangeable lateral frame members (30, 30A) are provided and each of the lateral frame members (30, 30A) includes a transverse part (31, 31*a*) whereby the lateral frame member is connected to the first frame member (11) and a forwardly extending part (32, 32*a*) whereby the overall width of the frame (10) can be varied by selecting lateral frame members (32, 32A) having a transverse part of differing length.

35. A wheeled frame according to claim 34 which additionally includes a further transversely extending frame member (50) which is releasably connectable to said lateral frame members (30) at or near the ends thereof remote from their connection with said first frame member (11).

36. A wheeled frame according to claim 34 wherein the support member (20) which carries the orthosis (60) is one of a plurality of such support members (20,20A) provided in a range of sizes to suit patients of differing height and weight.

37. An orthosis for use with a wheeled frame according to claim 34 and having a pair of leg supports (70) each of which includes an upper element (74) having a pivotal mounting (71) at its upper end whereby it is connected to a back support, a lower element (75) having a foot support member (100) at its lower end, and an intermediate pivotal connection (72) whereby the upper and lower elements are connected to one-another, wherein the upper and lower elements (74,75) of the leg supports (70) are releasably and adjustably secured to the upper pivotal mounting (76), to the intermediate pivotal connection (72) and to the foot support member (100), so that the effective length of each of said elements can be adjusted independently.

38. An orthosis according to claim 37 wherein each of said upper and lower elements (74,75) comprises a bar and end portions thereof are connected in overlapping relationship with the upper pivotal mounting (71), the intermediate pivotal connection (72) and the foot support member (100) as appropriate.

39. An orthosis according to claim 38 wherein the foot support member (100) includes a shoe clamp (103,105;103, 107) carried by a pivotal ankle joint (73) with a restricted and adjustable range of pivotal movement to provide control over the degree of dorsiflexion and plantiflexion at the ankle of the user.

* * * * *